US011581112B2

(12) United States Patent
Wang

(10) Patent No.: US 11,581,112 B2
(45) Date of Patent: Feb. 14, 2023

(54) METHOD FOR MANUFACTURING MINIATURE RESISTOR

(71) Applicant: Ralec Electronic Corporation, Kaohsiung (TW)

(72) Inventor: Tim Wang, Kaohsiung (TW)

(73) Assignee: RALEC ELECTRONIC CORPORATION, Kaohsiung (TW)

( * ) Notice: Subject to any disclaimer, the term of this patent is extended or adjusted under 35 U.S.C. 154(b) by 219 days.

(21) Appl. No.: 17/039,550

(22) Filed: Sep. 30, 2020

(65) Prior Publication Data

US 2022/0013262 A1 Jan. 13, 2022

(30) Foreign Application Priority Data

Jul. 7, 2020 (TW) ..... 109122885

(51) Int. Cl.
*H01C 17/07* (2006.01)
*H01C 17/245* (2006.01)

(52) U.S. Cl.
CPC ..... *H01C 17/07* (2013.01); *H01C 17/245* (2013.01)

(58) Field of Classification Search
CPC ..... H01C 17/07; H01C 17/245
See application file for complete search history.

(56) References Cited

U.S. PATENT DOCUMENTS 5,450,055 A * 9/1995 Doi ..... H01C 17/006 338/332
10,763,017 B2 * 9/2020 Kinoshita ..... H01C 7/06
2004/0252009 A1 * 12/2004 Tsukada ..... H01C 17/006 338/203
2006/0097340 A1 * 5/2006 Tsukda ..... H01C 1/144 257/516
2017/0271053 A1 * 9/2017 Yoneda ..... H01C 1/142
2020/0051716 A1 * 2/2020 Kinoshita ..... H01C 1/034
2022/0013261 A1 * 1/2022 Wang ..... H01C 17/003

FOREIGN PATENT DOCUMENTS

TW M439246 U1 10/2012
TW I435342 B 4/2014
TW I553672 B 10/2016

* cited by examiner

*Primary Examiner* — Kyung S Lee
(74) *Attorney, Agent, or Firm* — Muncy, Geissler, Olds & Lowe, P.C.

(57) ABSTRACT

A method for manufacturing a miniature resistor includes the steps of: providing a foil sheet; forming intersecting rows of slits to define a patterned foil sheet having a matrix array of resistor blanks that are interconnected at intersections of the intersecting rows; forming a resin film on a bottom surface of the patterned foil sheet; forming a plurality of protruding blocks on each resistor blanks; forming an encapsulating layer on atop surface of each resistor blanks without covering outer surfaces of the protruding blocks; performing a die cutting process to obtain individual resistor blanks; and forming two external electrodes respectively on the protruding blocks and on two side surfaces of the individual resistor blanks to obtain the miniature resistor.

6 Claims, 8 Drawing Sheets

METHOD FOR MANUFACTURING MINIATURE RESISTOR

CROSS-REFERENCE TO RELATED APPLICATION

This application claims priority of Taiwanese Patent Application No. 109122885, filed on Jul. 7, 2020.

FIELD

The present disclosure relates to a method for manufacturing a passive electronic component, and more particularly to a method for manufacturing a miniature resistor.

BACKGROUND

Miniature resistor is among one of the passive electronic components widely used in various electronic devices to implement a predetermined electrical resistance.

A conventional method for mass production of a miniature resistor basically involves first preparing a plate made of an electrically conductive material and then disposing a support sheet on a bottom surface of the plate. Thereafter, the plate is subjected to a die cutting process to form a plurality of resistor blanks 11 arranged in a matrix array, followed by subjecting a top surface of each of the resistor blanks 11 to a resistance trimming process so as to provide a predetermined resistance value to the resistor blanks 11. Subsequently, an insulating layer 13 is disposed to cover the resistor blanks 11, and then the resistor blanks 11 are subjected to the die cutting process to obtain individual resistor blanks 11 that are separated from one another. Finally, two external electrodes 14 are formed on two opposite sides surfaces of each of the individual resistor blanks 11, so as to obtain a conventional miniature resistor 100 including the resistor blank 11, the supporting layer 12, the insulating layer 13, and the two external electrodes 14 as shown in FIG. 1.

The aforementioned conventional method for mass production of the conventional miniature resistor 100 requires the step of providing a support sheet to avoid deformation of the plate due to the die cutting process, which would cause an increased thickness of the thus obtained conventional miniature resistor 100, difficulty in capturing a precise resistance value, the packaging being sticky or glue overflow, the supporting layer 12 peeling off, and various other technical issues. Therefore, those skilled in the art endeavor to solve the abovementioned and related technical issues by proposing various solutions as exemplified by Taiwanese Invention and Utility Model Patent Publications Nos. 1435342, 155367, M439246, etc., and continue to propose various manufacturing procedures so as to improve the overall production of the miniature resistor.

SUMMARY

Therefore, an object of the present disclosure is to provide a method for manufacturing a miniature resistor that can alleviate at least one of the drawbacks of the prior art.

According to the present disclosure, the method for manufacturing the miniature resistor includes the steps of:

(A) providing a foil sheet made of an electrically conductive material having a predetermined resistance value;

(B) forming a plurality of slits penetrating through the foil sheet and arranged in multiple longitudinal and transverse rows so as to define a patterned foil sheet, the patterned foil sheet including a plurality of resistor blanks arranged in a matrix array, a plurality of connecting regions situated at intersections of the longitudinal and transverse rows, and a framing strip that loops around the resistor blanks, the slits and the connecting regions, the slits aligned in each of the longitudinal and transverse rows being spaced apart from each other at intersections of the longitudinal and transverse rows, the resistor blanks being connected to each other by the connecting regions and the framing strip;

(C) forming a resin film made of an insulating material on a bottom surface of the patterned foil sheet in such a manner that the insulating material fills all of the slits;

(D) forming a plurality of protruding blocks made of an electrically conductive material on a top surface of each of the resistor blanks opposite to the resin film;

(E) forming an encapsulating layer made of an insulating material on the top surface of each of the resistor blanks without covering outer surfaces of the protruding blocks on each of the resistor blanks;

(F) performing a die cutting process to cut the resin film along the slits, the connecting regions and the framing strip so as to obtain individual resistor blanks that are separated from one another; and (G) forming two external electrodes respectively on the protruding blocks and on two opposite side surfaces of each of the individual resistor blanks, which are situated at two opposite ends of the top surface of the resistor blank so as to obtain the miniature resistor.

BRIEF DESCRIPTION OF THE DRAWINGS

Other features and advantages of the present disclosure will become apparent in the following detailed description of the embodiments with reference to the accompanying drawings, of which.

DETAILED DESCRIPTION

Figure 1:
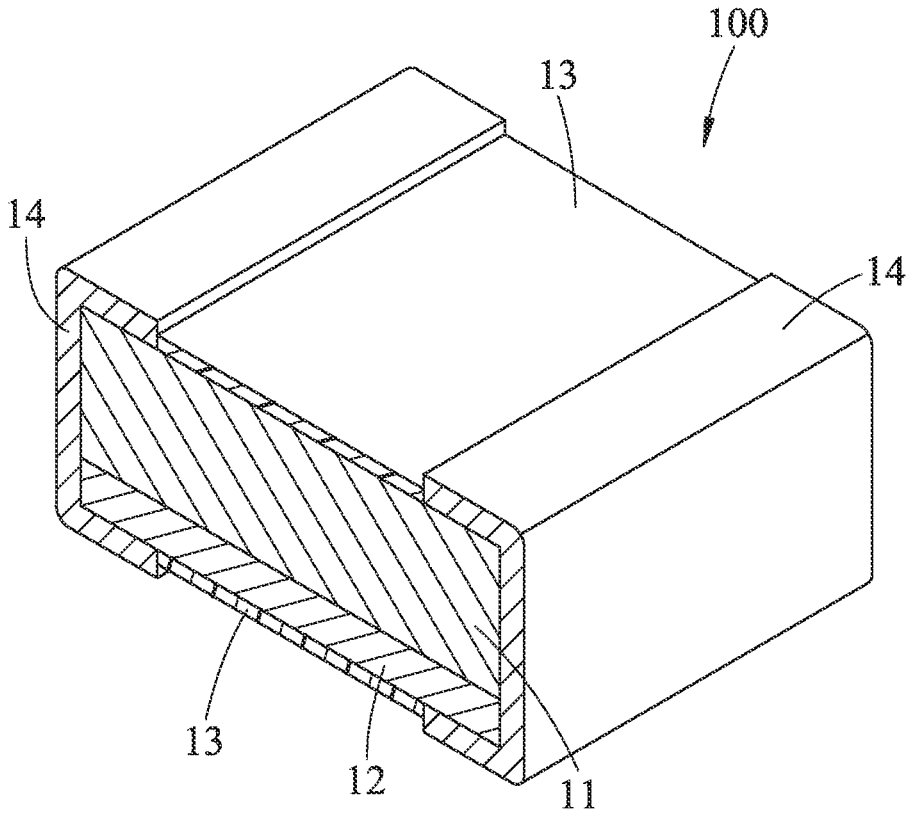
FIG.1 PRIOR ART
FIG. 1 is a sectional perspective view illustrating a conventional miniature resistor.

Before the present disclosure is described in greater detail, it should be noted that where considered appropriate, reference numerals or terminal portions of reference numerals have been repeated among the figures to indicate corresponding or analogous elements, which may optionally have similar characteristics.

Figure 2:
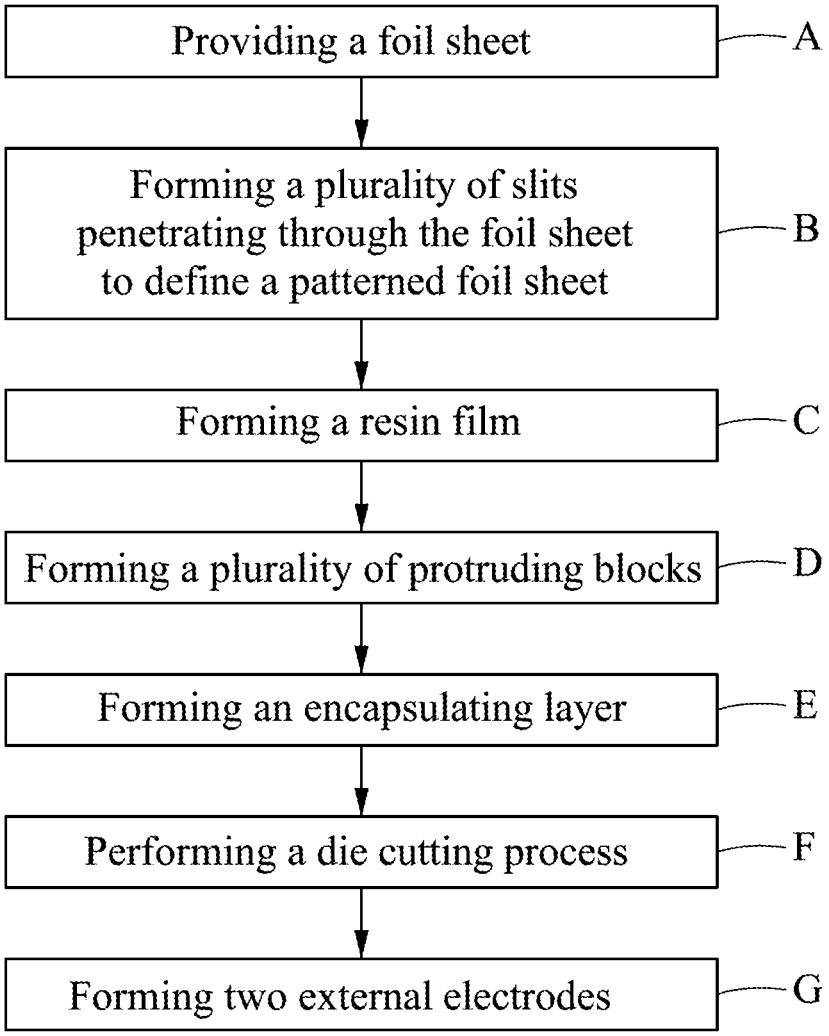
FIG. 2 is a flow chart illustrating the consecutive steps of an embodiment of a method for manufacturing a miniature resistor according to the present disclosure.
Figure 3:
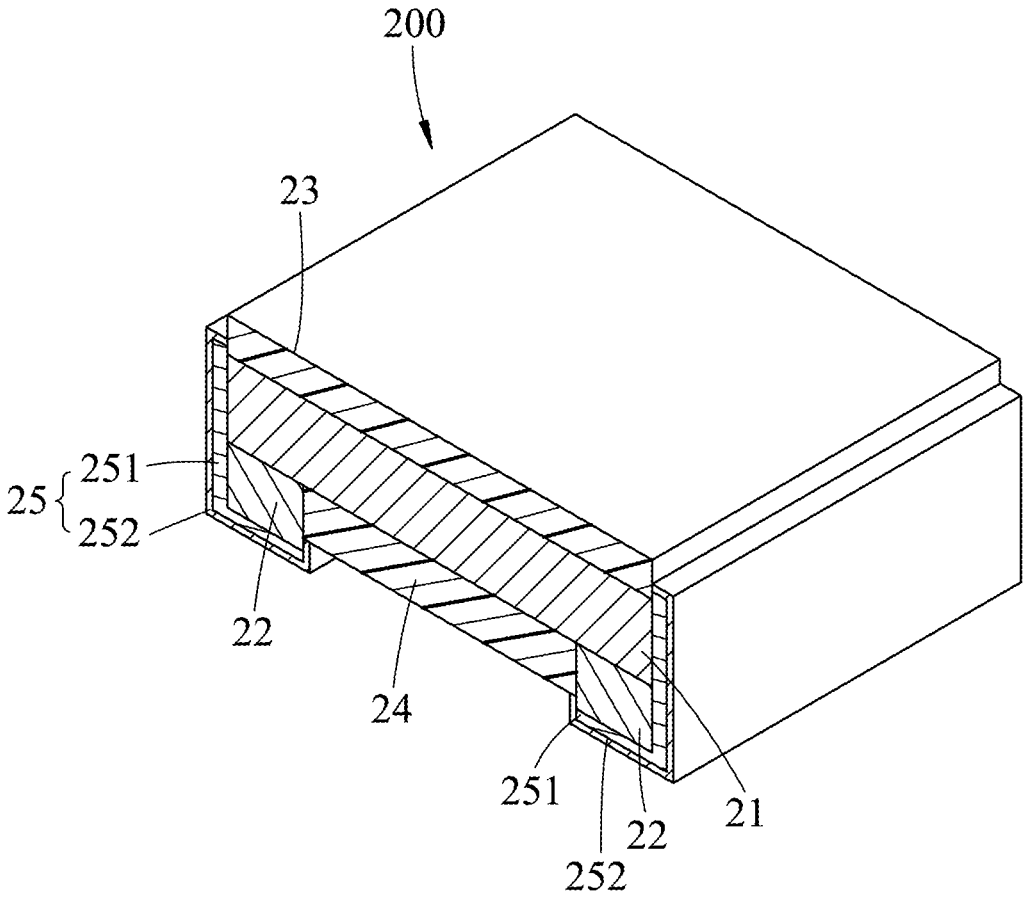
FIG. 3 is a sectional perspective view illustrating the miniature resistor manufactured by the embodiment.

Referring to FIGS. 2 and 3, a method for manufacturing a miniature resistor according to an embodiment of the present disclosure includes steps (A) to (G).

Figure 4:
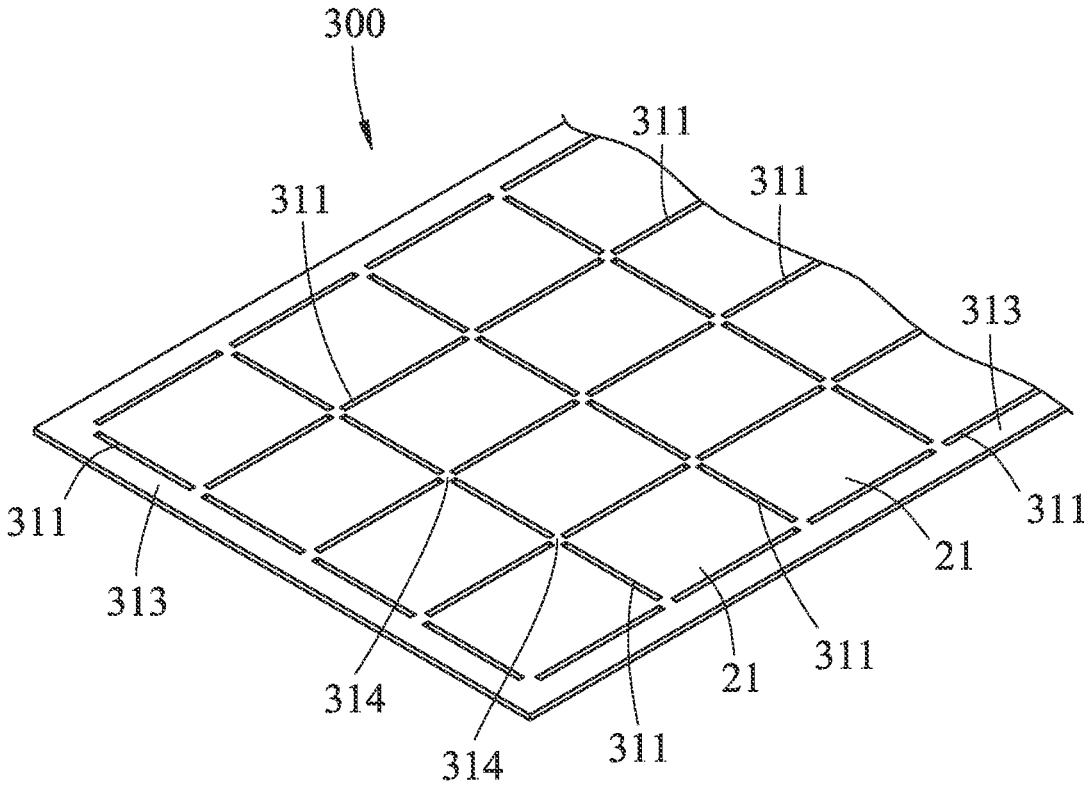
FIG. 4 is a fragmentary schematic view illustrating a patterned foil sheet formed by the method.
Figure 5:
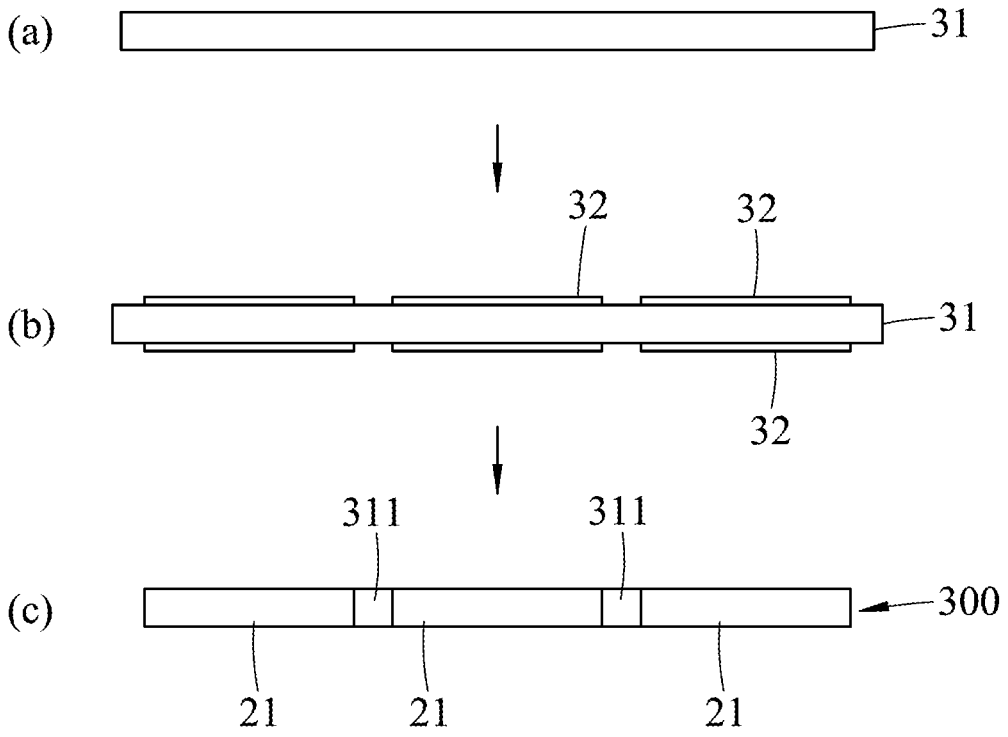
FIG. 5 is a schematic view illustrating a step of forming a plurality of slits to define the patterned foil sheet, in which the patterned foil sheet includes a plurality of resistor blanks.

In step (A), referring to FIG. 4 and FIG. 5(*a*), a foil sheet 31 made of an electrically conductive material having a predetermined resistance value is provided.

In step (B), referring again to FIGS. 2, to 5, a plurality of slits 311 which penetrate through the foil sheet 31 and which are arranged in multiple longitudinal and transverse rows are formed, so as to define a patterned foil sheet 300. In this embodiment, as shown in FIGS. 5(*b*) and 5(*c*), two photoresists 32 are first disposed on two opposite surfaces of the foil sheet 31, and are then etched inwardly from outer surfaces thereof at predetermined positions using photolithography to partially remove the photoresist layers 32 and the foil sheet 31, so as to form the slits 311, thereby obtaining the patterned foil sheet 300. The patterned foil sheet 300 includes a plurality of resistor blanks 21 arranged in a matrix array, a plurality of connecting regions 314 situated at intersections of the longitudinal and transverse rows, and a framing strip 313 that loops around the resistor blanks 21, the slits 311, and the connecting regions 314. The slits 311 aligned in each of the longitudinal and transverse rows are spaced apart from each other at intersections of the longitudinal and transverse rows. The resistor blanks 21 are connected to each other by the connecting regions 314 and the framing strip 313.

In other embodiments, the slits 311 may be formed to penetrate the foil sheet 31 by, but not limited to, laser or a stamping process.

Figure 6:
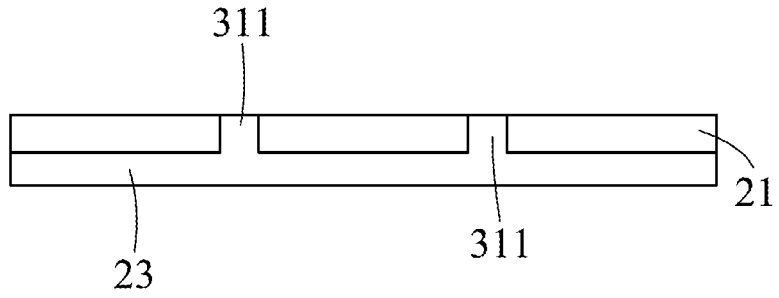
FIG. 6 is a schematic view illustrating a step of forming a resin film on a bottom surface of the patterned foil sheet which is performed after the step shown in FIG. 5.

In step (C), referring back to FIG. 2, in combination with FIG. 6, a resin film 23 made of an insulating material is formed on a bottom surface of the patterned foil sheet 300 opposite to a top surface of each of the resistor blanks 21, in such a manner that the insulating material fills all of the slits 311. In this embodiment, the resin film 23 is formed by hot pressing.

Figure 7:
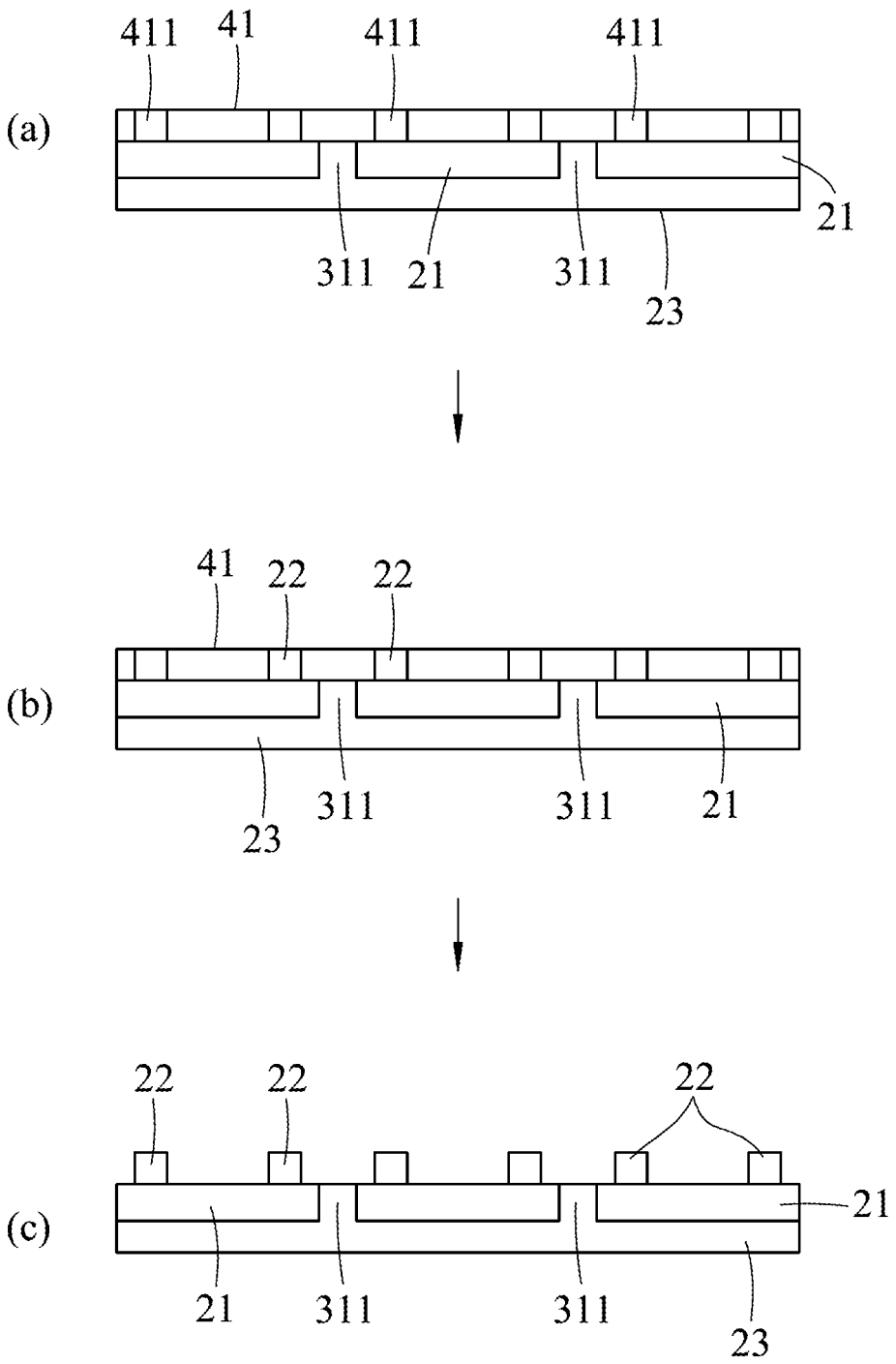
FIG. 7 is a schematic view illustrating a step of forming a plurality of protruding blocks on a top surface of the resistor blanks which is performed after the step shown in FIG. 6.

In step (D), referring back to FIG. 2, in combination with FIG. 7, a plurality of protruding blocks 22 made of an electrically conductive material are formed on a top surface of each of the resistor blanks 21 opposite to the resin film 23. To be specific, a photoresist film 41 is first attached to a surface of the patterned foil sheet 300 opposite to the resin film 23, and then is subjected to etching at predetermined positions using photolithography to form a plurality of through holes 411 that expose parts of the top surface of each of the resistor blanks 21 (see FIG. 7(*a*)), after which each of the through hole 411 is subjected to a plating process to form the protruding blocks 22 that are connected to the resistor blanks 21 (see FIG. 7(*b*)). In this embodiment, two of the protruding blocks 22 spaced apart from each other are formed on the top surface of each of the resistor blanks 21 (see FIG. 7(*c*)).

In certain embodiments, the protruding blocks 22 may be formed by a sputtering process, a printing process, etc. Since such processes are well known to those skilled in the art, further details thereof are not provided herein for the sake of brevity.

It should be noted that after step (C), flashes of the resin film 23 may be formed due to overflowing resin, which may adversely affect subsequent steps of the method. Therefore, after step (D), such flashes of the resin film 23 in proximity to the slits 311 are removed according to practical requirements.

Figure 8:
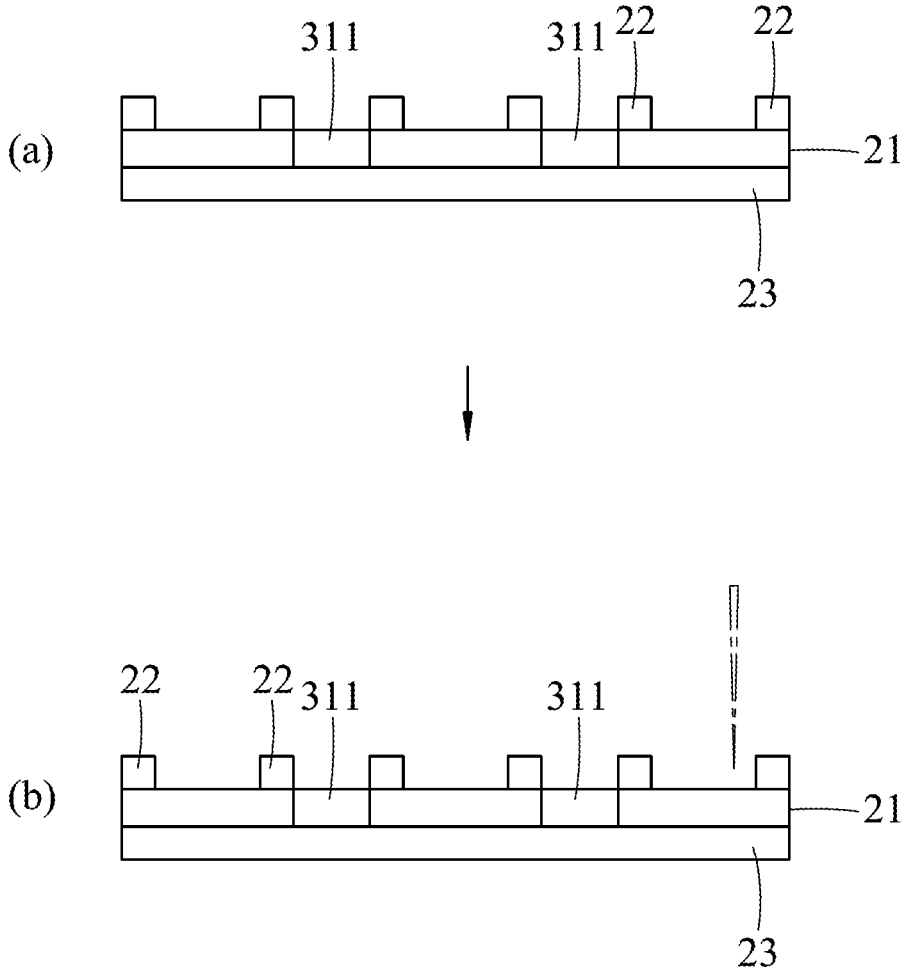
FIG. 8 is a schematic view illustrating two consecutive sub-steps of trimming portions of the resistor blanks and removing flashes of the resin film which are performed after the step shown in FIG. 7.

In certain embodiments, after step (D), some of the protruding blocks 22 thus formed are not coplanar with side surfaces of the resistor blanks 21 (see FIG. 7(*c*)), and thus, parts of the resistor blanks 21 in proximity to the protruding blocks 22 may be removed by a dicing process so that the protruding blocks 22 are arranged to be coplanar with side surfaces of the resistor blanks 21, and the slits 311 are widened (see FIG. 8(*a*)).

In this embodiment, after step (D), the two side surfaces and the top surface of each of the resistor blanks 21 which are not covered by the protruding blocks 22 are trimmed using laser (see FIG. 8(*b*)), so that the resistor blanks 21 are conferred with selected properties, e.g., a specific electrical resistance value.

Figure 9:
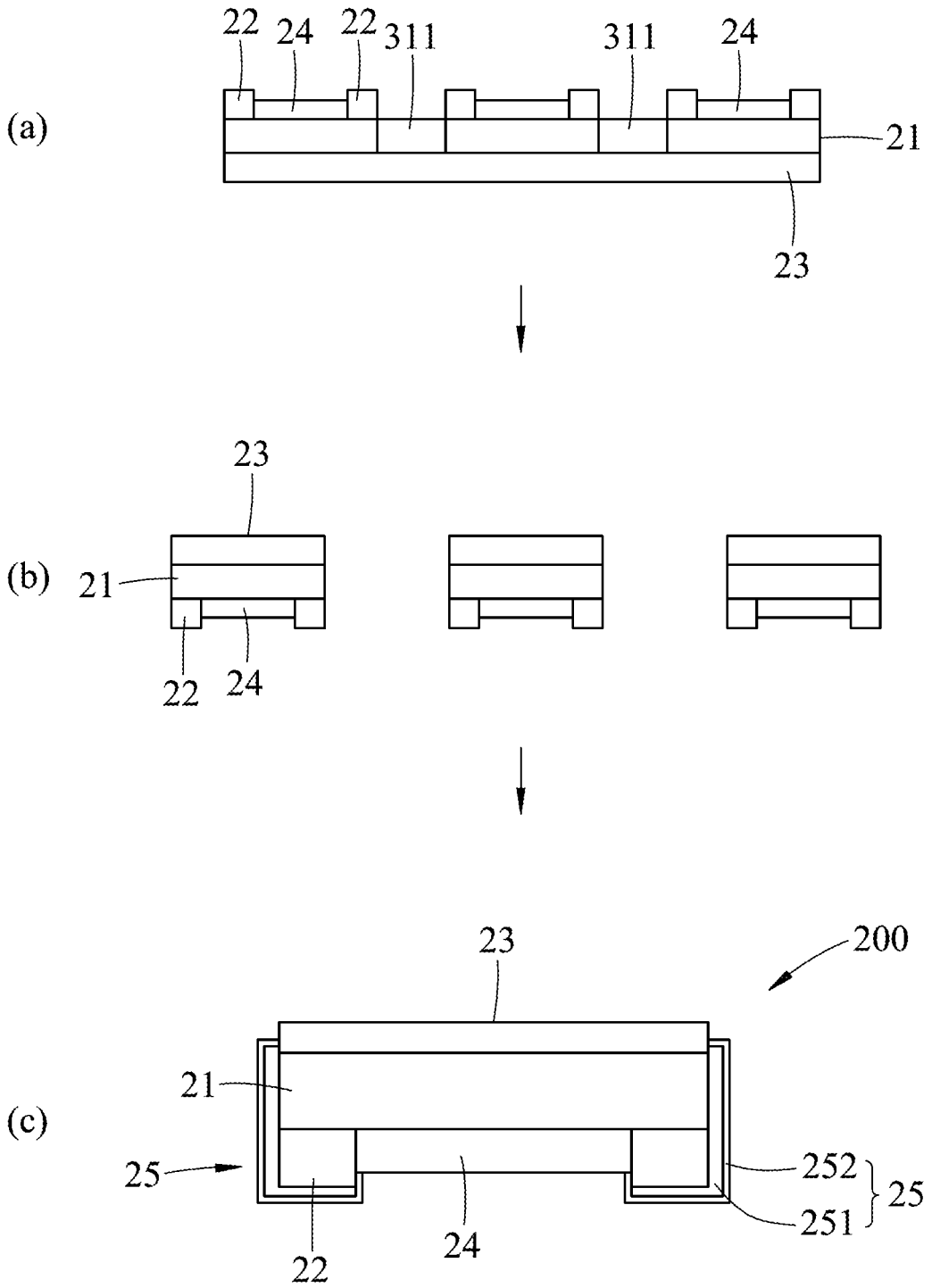
FIG. 9 is a schematic view illustrating three consecutive steps of forming an encapsulating layer, performing a die cutting process to obtain individual resistor blanks, and forming external electrodes so as to obtain the miniature resistor which are performed after the sub-steps shown in FIG. 8.

In step (E), referring back to FIG. 2, in combination with FIG. 9(*a*), an encapsulating layer 24 made of an insulating material is formed by a printing process on the top surface of each of the resistor blanks 21 without covering outer surfaces of the protruding blocks 22 on each of the resistor blanks 21. The encapsulating layer 24 covers and protects the resistor blanks 21.

In step (F), referring back to FIG. 2, in combination with FIG. 9(*b*), a die cutting process is performed to cut the resin film 23 along the slits 311, the connecting regions 314 and the framing strip 313, exposing the side surfaces of each of the resistor blanks 21 and the side surfaces of the protruding blocks 22, so as to obtain individual resistor blanks 21 that are separated from one another.

In step (G), referring back to FIG. 2, in combination with FIG. 9(*c*), two external electrodes 25 are respectively formed on the protruding blocks 22 and on two opposite side surfaces of each of the individual resistor blanks 21, which are situated at two opposite ends of the top surface of the resistor blank 21, so as to obtain the miniature resistor 200 as shown in FIG. 3. In this embodiment, each of the two external electrodes 25 includes two metallic layers, i.e., a nickel metal layer 251 and a tin metal layer 252, which are formed by electroplating. In other embodiments, the external electrodes 25 may be formed, but not limited to, by sputtering, surface deposition, etc. In addition, before electroplating, an electrically conductive film may be first formed on a surface of the individual resistor blank 21 by adhesion or plating, so as to serve as an electroplating medium for subsequent formation of the external electrodes 25.

In summary, by virtue of the method for manufacturing the miniator resistor according to the present disclosure, decrease in structural strength of the foil sheet 31 due to formation of slits 311 is improved through formation of the resin film 23 on the bottom surface of the patterned foil sheet 300, and a supporting sheet as required in the conventional manufacturing method is eliminated, and thus, simplifies the manufacturing method, so as to effectively reduce manufacturing cost and enables mass production of the miniature resistor 200. Moreover, the resin film 23 formed by hot pressing can be firmly attached to each of the resistor blanks 21 so as not to be easily peeled off during subsequent steps of the manufacturing method, and thus, manufacturing yield of the miniature resistor 200 is greatly enhanced.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the present disclosure has been described in connection with what is considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A method for manufacturing a miniature resistor, comprising the steps of:

(A) providing a foil sheet made of an electrically conductive material having a predetermined resistance value;

(B) forming a plurality of slits penetrating through the foil sheet and arranged in multiple longitudinal and transverse rows so as to define a patterned foil sheet, the slits in each of the longitudinal and transverse rows being aligned in an elongate direction of the slits, the patterned foil sheet including a plurality of resistor blanks arranged in a matrix array, a plurality of connecting regions situated at intersections of the longitudinal and transverse rows, and a framing strip that loops around the resistor blanks, the slits and the connecting regions, two adjacent ones of the slits aligned in each of the longitudinal and transverse rows being spaced apart from each other by one of the connecting regions at one of the intersections of the longitudinal and transverse rows, each of the resistor blanks being separated from an adjacent one of the resistor blanks by one of the slits and having four corners respectively connected to four of the connecting regions;

(C) forming a resin film made of an insulating material on a bottom surface of the patterned foil sheet in such a manner that the insulating material fills all of the slits;

(D) forming a plurality of protruding blocks made of an electrically conductive material on a top surface of each of the resistor blanks opposite to the resin film;

(E) forming an encapsulating layer made of an insulating material on the top surface of each of the resistor blanks without covering outer surfaces of the protruding blocks on each of the resistor blanks;

(F) performing a die cutting process to cut the resin film along the slits, the connecting regions and the framing strip so as to obtain individual resistor blanks that are separated from one another; and (G) forming two external electrodes respectively on the protruding blocks and on two opposite side surfaces of each of the individual resistor blanks, which are situated at two opposite ends of the top surface of the resistor blank so as to obtain the miniature resistor.

2. The method as claimed in claim 1, wherein the two side surfaces and the top surface of each of the resistor blanks not covered by the protruding blocks are trimmed using laser after step (D).

3. The method as claimed in claim 1, wherein flashes of the resin film in proximity to the slits are removed after step (D).

4. The method as claimed in claim 3, wherein the protruding blocks are arranged to be respectively coplanar with the side surfaces of the resistor blanks by removing parts of the resistor blanks in proximity to the protruding blocks after step (D).

5. The method as claimed in claim 1, wherein in step (D), two of the protruding blocks spaced apart from each other are formed on the top surface of each of the resistor blanks.

6. The method as claimed in claim 1, wherein in step (G), each of the two external electrodes includes two metallic layers.

* * * * *